United States Patent [19]

Kuder

[11] 4,383,899

[45] May 17, 1983

[54] ELECTROCHEMICAL PRODUCTION OF VINYL ACETATE

[75] Inventor: James E. Kuder, Fanwood, N.J.

[73] Assignee: Celanese Corporation, New York, N.Y.

[21] Appl. No.: 413,911

[22] Filed: Sep. 1, 1982

[51] Int. Cl.[3] ..... C25B 3/02

[52] U.S. Cl. ..... 204/59 R; 204/80; 560/208; 560/218

[58] Field of Search ..... 204/72, 80, 59 R

[56] References Cited

U.S. PATENT DOCUMENTS

| | | | |
|---|---|---|---|
| 3,248,312 | 4/1966 | Young | 204/80 |
| 3,560,354 | 2/1971 | Young | 204/80 |
| 3,985,794 | 10/1976 | Calcagno et al. | 260/497 A |
| 4,331,528 | 5/1982 | Beer et al. | 204/290 F |

FOREIGN PATENT DOCUMENTS

| | | | |
|---|---|---|---|
| 768138 | 9/1967 | Canada | 204/80 |

OTHER PUBLICATIONS

Journal of Electrochemical Society, vol. 117, No. 4, pp. 448–451 Hartley and Price, "Anodic Oxidation of Hydrocarbons", Apr. 1970.

*Primary Examiner*—Howard S. Williams
*Assistant Examiner*—T. F. Chapman
*Attorney, Agent, or Firm*—Depaoli & O'Brien

[57] ABSTRACT

This invention provides an electrochemical process for the production of vinyl acetate from ethylene and anolyte acetic acid at a constant anodic half cell potential and under, ambient conditions of temperature and pressure.

9 Claims, No Drawings

ELECTROCHEMICAL PRODUCTION OF VINYL ACETATE

BACKGROUND OF THE INVENTION

Vinyl acetate is an important chemical commodity which is produced in plant scale volumes. In one commercial process for vinyl acetate production, a supply of ethylene, acetic acid and oxygen is passed in vapor phase contact with a palladium catalyst. The overall efficiency of the process is limited by the need to control the highly exothermal nature of the reaction.

An alternative type of reaction system for producing vinyl esters is proposed in U.S. Pat. No. 3,248,312 and a related U.S. Pat. No. 3,560,354 patent.

In the Example of U.S. Pat. No. 3,248,312, an electrolytic cell is provided which has two chambers separated by a porous membrane. The anolyte consists of anhydrous acetic acid and 0.03 weight percent palladium and 10 weight percent lithium acetate. The catholyte consists of one normal sulfuric acid. Carbon electrodes are employed. The electrolytes are heated to 240° F. and a direct current voltage of 9.9 volts is applied to the cell to obtain a current density of 0.05 amperes per square centimeter of anode surface. The electrolytes are stirred while ethylene is fed into the anode chamber. Gaseous effluent from the anode chamber is collected in a condenser system as a liquid product mixture consisting of 23 percent vinyl acetate and 77 percent acetic acid.

The potential of electrochemistry as a viable route to vinyl esters such as vinyl acetate has merited continuing research effort.

Accordingly, it is an object of this invention to provide an improved electrochemical process for converting ethylene and acetic acid to vinyl acetate.

It is a further object of this invention to provide an efficient electrochemical process for vinyl acetate production under ambient conditions of temperature and pressure.

It is another object of this invention to provide an electrochemical process for anodic production of vinyl acetate from ethylene and acetic acid, wherein the electrolytic cell is operated at a constant potential.

Other objects and advantages of the present invention shall become apparent from the accompanying description and example.

DESCRIPTION OF THE INVENTION

One or more objects of the present invention are accomplished by the provision of an electrolytic cell system having anode and cathode chambers separated by a porous membrane, a working palladium metal anode, a counter electrode, an anolyte comprising glacial acetic acid and a soluble salt, and a catholyte; and said cell system is operated as an electrochemical process which comprises introducing ethylene into contact with the anolyte and palladium anode, providing a direct current voltage in the cell and maintaining a constant anodic potential between about 0.4–1.8 volts vs SCE, and recovering vinyl acetate product from the anode chamber.

A conventional electrolytic cell design is satisfactory for purposes of the present invention. In general, two chambers are employed which are separated by a porous diaphragm to prevent admixture of the electrolytes. The chambers can be constructed of or lined with stainless steel. The anode chamber is adapted with a conduit means for introduction of ethylene into the anode chamber.

The anode electrode is constructed of palladium metal, e.g., in the form of a foil or grid. The cathode electrode can be constructed of carbon, or any metal which is inert under the electrochemical conditions, e.g., a platinum or gold cathode.

The cell chambers are separated by a porous member which prevents diffusion of metal ions from the anolyte into the cathode chamber. Illustrative of porous membrane materials are fritted glass, asbestos, teflon, and the like.

An essential aspect of the electrochemical system is an anolyte which comprises glacial acetic acid and a salt that is soluble in the acetic acid, and which anolyte is substantially anhydrous.

The soluble salt is a supporting electrolyte, and preferably is an alkali metal salt such as sodium chloride, potassium nitrate, lithium fluoride, lithium benzoate, lithium acetate, and the like. The soluble salt in the anolyte can be employed in a quantity from about 0.1 weight percent up to a saturated solution in the glacial acetic acid. Typically, the quantity of soluble salt will range between about 1–20 percent based on the total weight of the anolyte.

The catholyte can be any suitable conducting medium, e.g., an aqueous mineral acid such as sulfuric acid, hydrochloric acid, hydrofluoric acid, and the like.

In the operation of the present invention electrochemical system for vinylacetate production, an essential feature is the maintenance of a constant anodic potential between about 0.4–1.8 vs SCE and preferably between about 0.5–1.0 volt vs SCE. The anodic potential level is selected for optimal current efficiency, so as to prevent the formation of oxidation products other than vinyl acetate.

A unique method for maintaining the anodic potential at a pre-selected optimal level for vinyl acetate production is by utilization of a passive potentiostat, which is adapted for controlling the half-cell potential of a thermodynamically favorable electrochemical process, e.g., a process operating in a fuel cell mode or battery mode.

In the present invention, the cathode chamber can be an oxygen half cell and the electrochemical process can be conducted in an electrogenerative mode. In this case, no application of an external source of voltage to the electrodes, is necessary.

A passive potentiostat device is disclosed in copending patent application Ser. No. 410,284, filed Aug. 23, 1982. The described passive potentiostat device is adapted to function as a self-adjustable unipolar resistive load, which device comprises:

an input electrometer circuit for measuring the potential between a reference electrode and a working electrode of a thermodynamically favorable electrochemical cell;

a variable reference offset voltage source circuit for preselecting a specific potential for the working electrode, and for algebraically combining the electrometer output potential with the selected potential to produce a signal which is the difference between the actual working electrode potential and the selected potential;

a voltage amplifier circuit for amplifying the said signal; and a dynamic load circuit for receiving the amplified signal and regulating the impedance of the dynamic load to adjust the half-cell potential of the working electrode to the selected potential level.

In operation, the passive potentiostat circuitry forms a closed loop control system when used in conjunction with a thermodynamically favorable electrochemical cell operation. A dynamic load resistance is placed across the cell electrodes, and a cell current is allowed to flow so as to maintain a fixed potential between the working and reference electrodes.

The input electrometer circuit receives the electrical signal from the cell reference electrode and provides an impedance buffering effect to prevent significant current flow in the reference electrode circuit, assuring proper operation of this electrode. Illustrative of a suitable electrometer amplifier is an Analog Devices Inc. type 40J, which has an input impedance of about $10^{11}$ Ohms and an output impedance of about $10^2$ Ohms. This amplifier is connected so as to have a voltage gain of unity.

The variable reference offset voltage source circuit has incorporated a voltage reference device such as an Analog Devices Inc. type AD584 Precision Voltage Reference. The device is combined with a power supply and voltage divider to provide a stable 0–2 volt electrically isolated DC source, which is combined algebraically with the electrometer output potential to produce a signal of appropriate sign and magnitude to control the passive potentiostatic load.

The resultant signal from the two circuits is amplified with a suitable amplifier device, such as type 741 operational amplifier (Texas Instruments Inc.). The amplifier is connected for a voltage gain of about 470.

The amplified signal is applied as a control voltage to the dynamic load circuit, which has incorporated a field-effect transistor, e.g., an International Rectifier Corp. type IRF531 power FET. The drain and source of the FET device respectively are connected to the positive and negative cell (load) terminals. The FET device is an essential feature of the passive potentiostat, in that it exhibits a very low "on" resistance of about 0.12 Ohms, independent of the applied drain-source voltage, and therefore can provide an effective load at very low cell potentials (e.g., less than 10 mV).

The drain-source of the passive potentiostat constitutes a passive, variable resistance load that provides a means of current flow from the electrochemical cell. The ohmic resistance of the load FET, and hence the inversely proportional current flow, are controlled by the electrometer signal (as measured against the negative "working" electrode). In addition, the amplified control signal can be input to two separate voltage comparators, one set to indicate an "open circuit" load condition (yellow LED), and the other a saturated or "minimum resistance" load condition (red LED). This provides a visual indication of the two end-point load situations.

During the operation of a present invention electrolytic cell system, the ethylene feedstream is introduced into the anode chamber so as to contact the anolyte and palladium anode. It is an advantage of the invention electrochemical process that the anode chamber can be operated under ambient conditions of temperature and atmosphere.

In one embodiment, the anodic chamber is operated on a continuous basis. Ethylene and anolyte are introduced continuously, and anolyte containing dissolved vinyl acetate is withdrawn continuously. The anolyte input and output also can be effected on an intermittent basis.

The vinyl acetate product is recovered from the withdrawn anolyte by any convenient method, such as distillation. The subsequently obtained vinyl acetate-free anolyte is then recycled to the anode chamber.

The anodic half-cell reaction in the invention electrochemical process may be represented as follows:

$$CH_2{=}CH_2 + OAc^- \rightarrow CH_2{=}CH{-}OAc + H^+ + 2e$$

When the cathode zone is an oxygen half cell, the electrochemical reaction may be represented as follows:

$$\tfrac{1}{2}O_2 + 2H^+ + 2e \rightarrow H_2O$$

It is preferred to operate the anode chamber under ambient conditions of temperature and pressure, e.g., at a temperature between about 20°–40° C. and at atmospheric pressure. An interesting advantage of the invention electrochemical oxidation process is the production of vinyl acetate without the exothermicity characteristic of the commercial vapor phase process described in the Background Of Invention section above.

An anodic half-cell potential of 0.4–1.8 volts vs SCE corresponds approximately to a current density (milliamperes per square centimeter) range of 0.006–4.0, and 0.5–1.0 volt vs SCE corresponds to a current density of 0.03–0.5.

The following Example is further illustrative of the present invention. The specific ingredients and processing parameters are presented as being typical, and various modifications can be derived in view of the foregoing disclosure within the scope of the invention.

EXAMPLE

The cell employed for the electrolysis is a three-chamber glass cell with the working electrode chamber and counter electrode chamber separated by a medium porosity glass frit, and the reference electrode chamber connected to the working electrode chamber by means of a fine porosity glass frit. The working electrode (anode) is a 25 mm×25 mm palladium foil, the counter electrode (cathode) is a platinum screen, and the reference electrode is a saturated calomel electrode (SCE). The electrolyte in the anode and cathode chambers is one molar lithium acetate in glacial acetic acid. The anode and cathode chambers each contain 50 ml of the electrolyte, while the reference chamber contains sufficient electrolyte solution to cover the tip of the SCE.

Ethylene gas is introduced into the anolyte by means of a bubbler consisting of a glass tube drawn to a diameter of about 1 mm at the tip, so that the gas emerges as a stream of fine bubbles.

A potential of +0.80 volt vs SCE is applied to the palladium anode by means of a PARC model 173 potentiostat, while the current is monitored by means of a Digitec model 2120 Multimeter, and the charge passed by an ESC model 640 Digital Coulometer. The current density initially is at a low level, and then after several hours increases to a constant value of about 0.36 milliamp/cm$^2$. The reaction is continued until 121.5 coulombs of electricity have passed.

Gas chromatographic analysis on an aliquot of the anolyte indicates the presence of vinyl acetate at a concentration of 729 μg/ml, corresponding to a current efficiency of 67.2%.

The calculation is as follows. For the anode reaction:

$$CH_2{=}CH_2 + OAc^- \rightarrow CH_2{=}CHOAc + H^+ + 2e^-$$

The theoretical yield is as follows:

$$(121.5 \text{ coulombs})/(9.648\times10^{4} \text{ coulombs/faraday})(2 \text{ faradays/mole})=6.29\times10^{-4} \text{ mole}$$

The analytical yield is as follows:

$$(7.29\times10^{-4} \text{ g/ml})(50 \text{ ml})/(86.09 \text{ g/mole})=4.23\times10^{-4} \text{ mole}$$

Then $$CE=(4.23\times10^{-4})(100\%)/(6.29\times10^{-4})=67.2\%$$

In the case of an electrogenerative mode of operation:

(Anode)
$$CH_2{=}CH_2+H^{+}+OAc^{-}\rightarrow CH_2{=}CHOAc+2H^{+}+2e^{-}$$

(Cathode) $2H^{+}+\frac{1}{2}O_2+2e^{-}\rightarrow H_2O$ (Overall)
$$CH_2{=}CH_2+HOAc+\tfrac{1}{2}O_2\rightarrow CH_2{=}CHOAc+H_2O$$

The overall reaction is thermodynamically spontaneous with a free energy change of −37.53 kcal/mole. The corresponding cell voltage for such an electrogenerative reaction is about 0.81 volt.

What is claimed is:

1. In an electrolytic cell having anode and cathode chambers separated by a porous membrane, a working palladium metal anode, a counter electrode, an anolyte comprising glacial acetic acid and a soluble salt, and a catholyte; the operation of an electrochemical process which comprises introducing ethylene into contact with the anolyte and palladium anode, providing a direct current voltage in the cell and maintaining a constant anodic potential between about 0.4–1.8 volts, and recovering vinyl acetate product from the anode chamber.

2. A process in accordance with claim 1 wherein the anolyte is substantially anhydrous.

3. A process in accordance with claim 1 wherein the soluble salt in the anolyte is an alkali metal salt.

4. A process in accordance with claim 1 wherein the soluble salt in the anolyte is an alkali metal acetate.

5. A process in accordance with claim 1 wherein the catholyte is aqueous mineral acid.

6. A process in accordance with claim 1 wherein the cell is operated under ambient conditions of temperature and pressure.

7. A process in accordance with claim 1 wherein the maintained voltage is between about 0.5–1.0 volt.

8. A process in accordance with claim 1 wherein the cathode chamber is an oxygen half cell, and the electrochemical process is conducted in an electrogenerative mode.

9. A process in accordance with claim 1 wherein the constant anodic potential is maintained by means of a passive potentiostat.

* * * * *